US005765996A

United States Patent [19]

Fujii et al.

[11] Patent Number: 5,765,996

[45] Date of Patent: Jun. 16, 1998

[54] VIBRATION PREVENTING STRUCTURE IN SWASH PLATE TYPE COMPRESSOR

[75] Inventors: Toshiro Fujii; Koichi Ito; Kazuaki Iwama; Katsuya Ohyama, all of Kariya, Japan

[73] Assignee: Kabushiki Kaisha Toyoda Jidoshokki Seisakusho, Kariya, Japan

[21] Appl. No.: 415,543

[22] Filed: Apr. 3, 1995

[30] Foreign Application Priority Data

Apr. 8, 1994 [JP] Japan ..... 6-071163
Apr. 12, 1994 [JP] Japan ..... 6-073572

[51] Int. Cl.[6] ..... F04B 27/08
[52] U.S. Cl. ..... 417/269
[58] Field of Search ..... 417/269, 272

[56] References Cited

U.S. PATENT DOCUMENTS 5,252,032 10/1993 Iwanami et al. ..... 417/269 X
5,380,163 1/1995 Fujii et al. ..... 417/269 X

FOREIGN PATENT DOCUMENTS 2101080 8/1990 Japan .

*Primary Examiner*—Richard E. Gluck
*Attorney, Agent, or Firm*—Brooks Haidt Haffner & Delahunty

[57] ABSTRACT

A compressor has a plurality of cylinder bores defined around a rotary shaft in a cylinder block and a plurality of double-headed pistons accommodated in the respective cylinder bores. The pistons compress refrigerant gas in a plurality of front and rear compression chambers defined in the bores in the front and rear of the respective pistons according to the rotation of a cam plate mounted on the rotary shaft. The compressor has bearing that receive thrust loads applied to the rotary shaft during operation of the compressor. The pistons create a net thrust load determined by the difference between the maximum of the sum of loads applied to the front sides of the pistons by the refrigerant gas in the front compression chambers and the maximum of the sum of loads applied to the rear sides of the pistons by the refrigerant gas in the rear compression chambers. The pistons transfer the net thrust load to the rotary shaft in a predetermined direction.

24 Claims, 13 Drawing Sheets

VIBRATION PREVENTING STRUCTURE IN SWASH PLATE TYPE COMPRESSOR

BACKGROUND OF THE INVENTION

1. Field of the Invention

The present invention relates to a cam plate type compressor in which a plurality of double-headed pistons reciprocate in respective cylinder bores as a cam plate on a rotary shaft rotates, thus compressing refrigerant gas in the compression chamber in each cylinder bore. More specifically, this invention relates to a structure for preventing vibration during the operation of the compressor.

2. Description of the Related Art

In general, a compressor is used in an air conditioning system or a freezer. For example, in order to air-condition the compartment in a vehicle, a compressor compresses refrigerant gas, supplied from an external refrigeration circuit, and then discharges the gas to the external refrigeration circuit.

Japanese Unexamined Utility Model No. Hei 2-101080 discloses this type of compressor. This compressor has a plurality of (e.g., five) cylinder bores arranged at equiangular distances around its rotary shaft with a plurality of reciprocatable double-headed pistons retained in the respective cylinder bores. When a swash plate rotates together with the rotary shaft, each piston reciprocates. When each piston moves forward, the refrigerant gas in each compression chamber pushes a discharge valve open and moves out to a discharge chamber. When each piston moves backward, the refrigerant gas in each compression chamber pushes an inlet valve open and moves into the compression chamber.

The swash plate and rotary shaft of this compressor are supported on a cylinder block by a pair of radial bearings and a pair of thrust bearings. Therefore, the radial load on the rotary shaft is received through the radial bearings by the cylinder block, and the thrust load on the rotary shaft is received through the thrust bearings by the cylinder block.

The thrust load on the rotary shaft changes almost along a cosine curve as shown by a curve $C_1$ in FIG. 5. In FIG. 5, the horizontal scale represents the rotational angle of the rotary shaft and the vertical scale represents the size and direction of the thrust load. The symbol "+" represents the thrust load acting rearward in of the compressor, and the symbol "−" represents the thrust load acting forward in the compressor. When there are five pistons, it is apparent from FIG. 5 that while the rotary shaft rotates once, the acting direction of the thrust load alternately changes fives times, and the maximum values $F_{max0}$ of the thrust load in different directions alternately appear.

Each of the thrust bearings described previously has a pair of races and a plurality of rollers provided between the races. The races of those bearings are predeformed to apply a pre-load in the thrust direction to the rotary shaft. This pre-load is set higher than the maximum value of the thrust load to reduce the trembling of the rotary shaft in the thrust direction thereby suppressing the occurrence of vibration and noise in advance.

Since the flexing of the races varies, however, the pre-load is likely to be set greater than necessary to anticipate the variation. The excess pre-load increases the rotational resistance of the rotary shaft and swash plate thus increasing the power loss.

SUMMARY OF THE INVENTION

Accordingly, the present invention has been made to solve the above problems, and it is a primary objective of the present invention to provide a cam plate type compressor capable of both suppressing the vibration of the compressor and suppressing the power loss.

The compressor of the present invention has a plurality of cylinder bores defined around a rotary shaft in a cylinder block and a plurality of double-headed pistons accommodated in the respective cylinder bores. The pistons compress refrigerant gas in a plurality of front and rear compression chambers defined in the bores in the front and rear of the respective pistons according to the rotation of a cam plate mounted on the rotary shaft. The compressor comprises bearing that receive thrust loads applied to the rotary shaft during operation of the compressor. A net thrust load determined by the difference between the maximum of the sum of the loads applied to the front side of the pistons by the refrigerant gas in the front compression chambers and the maximum of the sum of the loads applied to the rear sides of the pistons by the refrigerant gas in the rear compression chambers is produced. The pistons transfer the net thrust load to the rotary shaft in a predetermined direction.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 12(*b*) is a graph showing a change in thrust load;

FIG. 12(*c*) is a graph showing a change in thrust load;

DETAILED DESCRIPTION OF THE PREFERRED EMBODIMENTS

A first embodiment of the present invention will now be described with reference to FIGS. 1 through 5.

Figure 1:
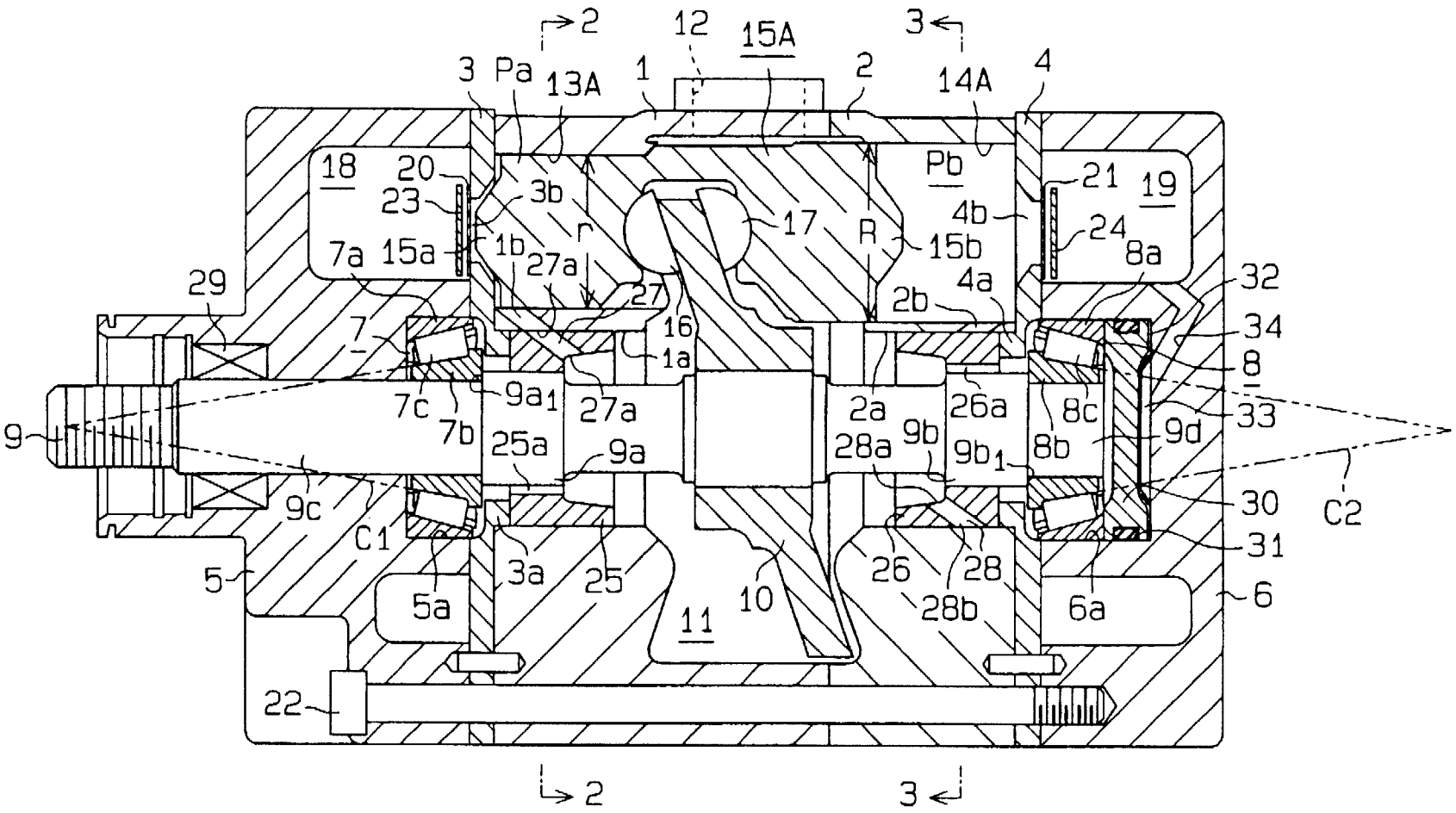
FIG. 1 is a side cross-sectional view illustrating a first embodiment of the present invention.

As shown in FIG. 1, a pair of cylinder blocks 1 and 2 are coupled together. A front housing 5 is connected via a valve plate 3 to the outer end face of the front cylinder block 1, and a rear housing 6 is likewise connected via a valve plate 4 to the outer end face of the rear cylinder block 2. The cylinder blocks 1 and 2, the valve plates 3 and 4, the front housing 5 and the rear housing 6 are fastened by bolts 22. A pair of retaining holes 1*a* and 2*a* are formed in the center portions of both cylinder blocks 1 and 2 so as to communicate with each other. Annular projections 3*a* and 4*a* are formed on the valve plates 3 and 4. The projections 3*a* and 4*a* are fitted in the respective holes 1*a* and 2*a* to position the valve plates 3 and 4 to the cylinder blocks 1 and 2.

Support holes 5*a* and 6*a* are formed at the center portions of the front housing 5 and the rear housing 6, respectively, and communicate with the respective retaining holes 1*a* and 2*a*. Bearings 7 and 8, each having a plurality of rollers with a truncated cone shape, are accommodated in the support holes 5*a* and 6*a*, respectively. A rotary shaft 9 is rotatably supported on the front housing 5 and rear housing 6 via the bearings 7 and 8. An outer race 7*a* of the bearing 7 abuts on the bottom and inner wall of the associated support hole 5*a*.

Inner races 7*b* and 8*b* of the bearings 7 and 8 abut on step portions 9*a*1 and 9*b*1, respectively, between large diameter portions 9*a* and 9*b* and a small diameter portion 9*c* of the rotary shaft 9. The rollers 7*c* of the bearing 7 are located between the outer race 7*a* and the inner race 7*b*, and the rollers 8*c* of the bearing 8 are located between the outer race 8*a* and the inner race 8*b*. The front rollers 7*c* are arranged on the circumference of an imaginary cone C1, which converges toward the front of the compressor, and the rear rollers 8*c* are arranged on the circumference of an imaginary cone C2, which converges toward the rear of the compressor. The bottoms of the two imaginary cones C1 and C2 therefore face each other. Each of the rollers 7*c* and 8*c* has an outer end positioned near the rotary shaft 9 and an inner end positioned apart from the rotary shaft 9.

The rotary shaft 9 is secured to a swash plate 10 serving as a cam plate. A swash plate chamber 11 is formed between the cylinder blocks 1 and 2, which have inlet ports 12. An external refrigeration circuit (not shown) is connected to the inlet ports 12 so that refrigerant gas is supplied via the inlet ports 12 in the swash plate chamber 11 from the external refrigeration circuit.

Figure 2:
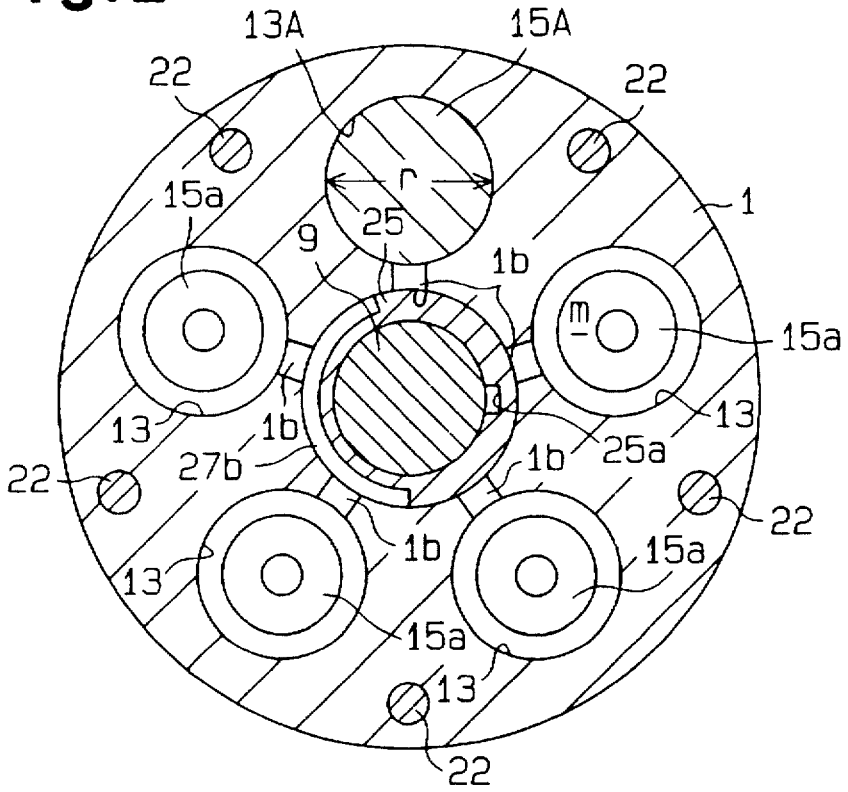
FIG. 2 is a cross-sectional view along the line 2—2 in FIG. 1.
Figure 3:
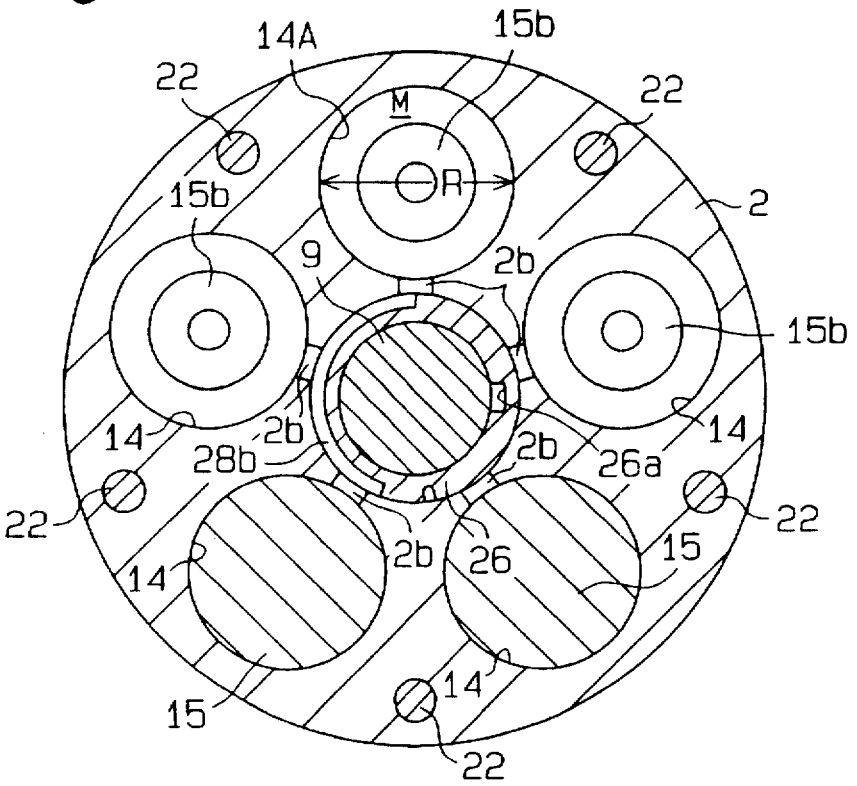
FIG. 3 is a cross-sectional view along the line 3—3 in FIG. 1.

As shown in FIGS. 2 and 3, five cylinder bores 13A, are formed in the cylinder block 1, and five cylinder bores 14, 14A are formed in the cylinder block 2. The bores 13, 13A, 14, 14A are formed at equiangular distances about the rotary shaft 9. The five front cylinder bores 13, 13A make axially aligned pairs with the five rear cylinder bores 14, 14A, and each pair of cylinder bores retains a reciprocating double-headed piston 15 or 15A. The rotational movement of the swash plate 10 is converted to the reciprocal movement of the pistons 15, 15A via shoes 16 and 17. When the swash plate 10 rotates, therefore, the pistons 15, 15A move forward and backward in their respective cylinder bores 13, 13A and 14, 14A.

The diameter "r" of the front cylinder bores 13, 13A is made smaller than the diameter "R" of the cylinder bores 14, 14A. Accordingly, the pressure-receiving area "m" of a front head, 15*a*, of each piston 15, 15A is smaller than the pressure-receiving area "M" of a rear head 15*b*.

Discharge chambers 18 and 19 are formed in the peripheral portions of the front housing 5 and the rear housing 6, respectively. The heads 15*a* and 15*b* of each piston 15, 15A define two compression chambers Pa and Pb in each pair of cylinder bores 13 and 14. The compression chambers Pa and Pb are connected respectively to the front and rear discharge chambers 18 and 19 via discharge ports 3*b* and 4*b* in the front and rear valve plates 3 and 4. The individual discharge ports 3*b* and 4*b* are selectively opened or closed by flapper type discharge valves 20 and 21. The degree of opening the of discharge ports 3*b* and 4*b* by the discharge valves 20 and 21 is restricted by retainers 23 and 24, respectively. The individual discharge chambers 18 and 19 are connected to the aforementioned external refrigeration circuit.

Rotary valves 25 and 26 having an almost cylindrical shape are fixed to the outer surfaces of the large diameter portions 9*a* and 9*b* of the rotary shaft 9, respectively. The rotary valves 25 and 26 are respectively accommodated in the retaining holes 1*a* and 2*a*. Formed in the inner walls of the rotary valves 25 and 26 respectively are bleeding passages 25*a* and 26*a*, which permit the support holes 5*a* and 6*a* to communicate with the swash plate chamber 11. A lip seal 29 is provided between the front housing 5 and the rotary shaft 9 to prevent leakage of the refrigerant gas to outside the compressor from the support hole 5*a*.

As shown in FIG. 2, suction ports 1*b* equal in number to the front cylinder bores 13, 13A are formed in the front cylinder block 1 at equiangular distances between the front retaining hole 1*a* and the front cylinder bores 13, 13A. The individual suction ports 1*b* are always connected to the cylinder bores 13, 13A.

Likewise, as shown in FIG. 3, suction ports 2*b* equal in number to the rear cylinder bores 14, 14A are formed in the rear cylinder block 2 at equiangular distances between the rear retaining hole 2*a* and the rear cylinder bores 14, 14A. The individual suction ports 2*b* are always connected to the cylinder bores 14, 14A.

Each rotary valve 25, 26 has a single suction passage 27 or 28. Inlets 27*a* and 28*a* of the suction passages 27 and 28 are open to the swash plate chamber 11, while outlets 27*b* and 28*b* are open to the outer surfaces of the rotary valves 25 and 26. When the rotary valves 25 and 26 rotate, therefore, the suction passages 27 and 28 successively cause the swash plate chamber 11 to communicate with the cylinder bores 13, 13A and 14, 14A via the individual suction ports 16, 2*b*.

The piston 15A shown in FIGS. 1, 2 and 3 is positioned at the top dead center with respect to the front cylinder bore 13A, and is positioned at the bottom dead center with respect to the rear cylinder bore 14A. When the piston 15A is located at such a position, the outlet 27*b* of the suction passage 27 is just before the connection to the suction port 1*b* of the front cylinder bore 13A, while the outlet 28*b* of the suction passage 28 is just before the disconnection from the suction port 2*b* of the rear cylinder bore 14A. When the piston 15A starts moving downward from the top dead center to the bottom dead center with respect to the front cylinder bore 13A in the suction stroke for this cylinder bore 13A, the suction passage 27 is connected to the compression chamber Pa of the cylinder bore 13A as the rotary valve 25 rotates. Consequently, the refrigerant gas in the swash plate chamber 11 is supplied into the compression chamber Pa of the cylinder bore 13A via the suction passage 27.

When the piston 15A starts moving upward from the bottom dead center to the top dead center with respect to the front cylinder bore 14A in the discharge stroke for cylinder bore 14A at the same time the suction stroke for the front cylinder bore 13A is carried out, the suction passage 28 is disconnected from the compression chamber Pb of the cylinder bore 14A, as the rotary valve 26 rotates. Consequently, the refrigerant gas in the compression chamber Pb is discharged into the discharge chamber 19 via the discharge port **4*b* while pushing the discharge valve 21** open. The discharged refrigerant gas is returned to the external refrigeration circuit.

The above-described suction and discharge operations of the refrigerant gas are likewise performed for the compression chambers Pa and Pb of the other cylinder bores 13 and 14.

The structure of the bearings will now be described in detail.

Figure 4:
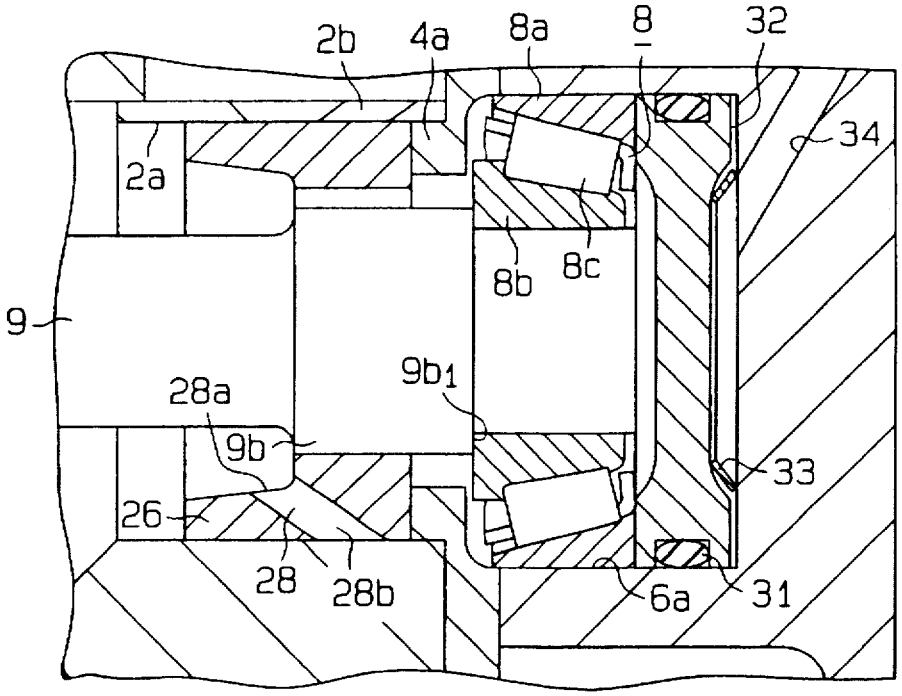
FIG. 4 is a fragmentary side cross-sectional view of the compressor.

As shown in FIGS. 1 and 4, the front end of the rotary shaft 9 protrudes outward from the front housing 5, and the rear end is placed in the support hole **6*a* of the rear housing 6. A partition 30 as a transmitting member is retained in the support hole 6*a* in such a way as to be slidable along the axis of the rotary shaft 9. The partition 30 abuts on the outer race 8*a* of the roller bearing 8 without contacting the inner race 8*b*. A seal ring 31 intervenes between the partition 30 and the surface of the support hole 6*a*. The partition 30 defines a pressure chamber 32 at the back of the support hole 6*a*. A belleville spring 33 is placed in the pressure chamber 32. This belleville spring 33 pushes the partition 30 against the outer race 8*a* of the roller bearing 8 to apply a frontward load to the rotary shaft 9 via the bearing 8. This pre-load is transmitted to and engages the front step portion 9*a*1 of the rotary shaft 9 with the front roller bearing 7**.

The pressure chamber 32 is connected via a passage 34 to the discharge chamber 19. Accordingly, the discharge pressure of the refrigerant gas acts on the pressure chamber 32, and the discharge pressure in the pressure chamber 32 acts against the suction pressure in the support hole **6*a* via the partition 30. Since the discharge pressure is normally greater than the suction pressure, the presence of the pressure chamber 32 supplement the pre-load applied to the rotary shaft 9**.

When the swash plate 10 rotates together with the rotary shaft 9, the five pistons 15 reciprocate in the respective cylinder bores 13 and 14 via the shoes 16, 17. In accordance with the reciprocation of each piston 15, the refrigerant gas is supplied to the swash plate chamber 11 via the inlet ports 12. As the rotary valves 25 and 26 rotate together with the rotary shaft 9, the gas in the swash plate chamber 11 is supplied to the compression chambers Pa and Pb in order after passing through the suction passages 27 and 28 of the rotary valves 25 and 26. The gases are compressed in the individual compression chambers Pa and Pb, and are then discharged to the discharge chambers 18 and 19 via the discharge ports **3*b* and 4*b* and the discharge valves 20 and 21**.

When the gases are compressed, the pressures in the front and rear compression chambers Pa and Pb act on the front head **15*a* and rear head 15*b* of each piston 15. The difference between the sum of the pressures acting on the individual front heads 15*a* and the sum of the pressures acting on the individual rear heads 15*b* is transmitted as a net thrust load in the thrust direction to the rotary shaft 9 via the pistons 15, 15A, shoes 17 and swash plate 10**.

Figure 5:
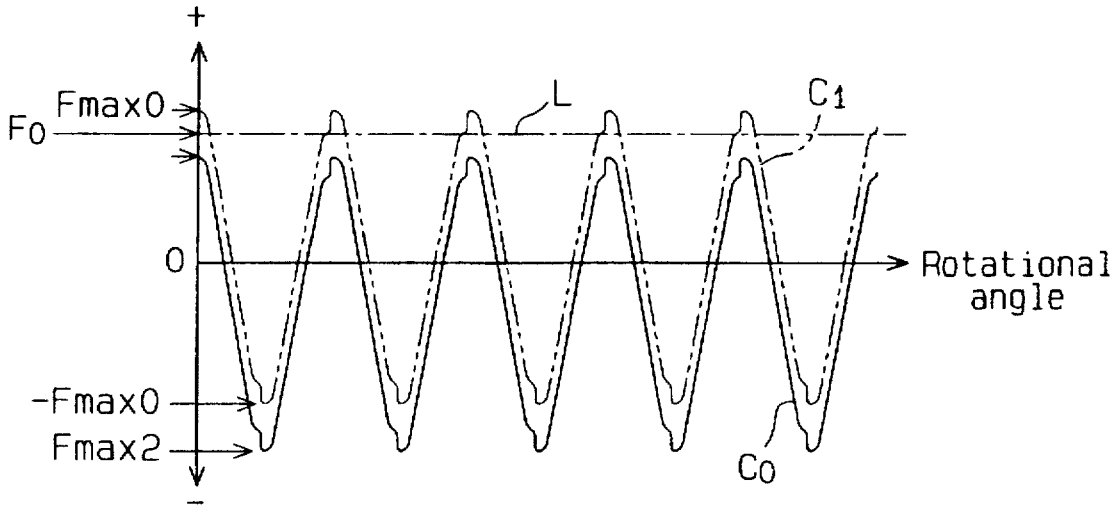
FIG. 5 is a graph illustrating the thrust load on a rotary shaft.

This net thrust load varies as indicated by a curve $C_0$ in the graph in FIG. 5. The vertical scale of the graph represents the size and direction of the load and the horizontal scale indicates the rotational angle of the rotary shaft 9. The symbol "+" in the graph represents the thrust load acting toward the rear housing 6 from the front housing 5 (hereinafter called "front thrust load"), and the symbol "–" represents the thrust load toward the front housing 5 from the rear housing 6 (hereinafter called "rear thrust load"). In this embodiment too, as indicated by the curve $C_0$, the acting direction of the thrust load alternately changes fives times and the size of the thrust load is generally shifted toward the minus side on the vertical scale.

The rear thrust load on the rotary shaft 9 is received by the front roller bearing 7 and is transmitted to the front housing 5. The front thrust load is received by the rear roller bearing 8, the partition 30 and the belleville spring 33 and is transmitted to the rear housing 6.

If the areas of the front and rear heads **15*a* and 15*b* are the same as in the prior art, the size of the front thrust load should approximately equal the size of the rear thrust load as indicated by a curve $C_1$ in FIG. 5. In this embodiment, however, the area "m" of the front heads 15*a* of the pistons 15, 15A is set smaller than the area "M" of the rear heads 15*b*. When the pressures in the front and rear compression chambers Pa and Pb are equal to each other, the force acting on the rear heads 15*b* is greater than the force acting on the front heads 15*a*. As a result, as indicated by the curve $C_0$ in FIG. 5**, the size of the thrust load is shifted toward the minus side on the vertical scale more than in the case of the curve $C_1$, so that the maximum value $F_{max1}$ of the front thrust load becomes smaller than the maximum value $F_{max2}$ of the rear thrust load.

If the areas of the front and rear heads **15*a* and 15*b* of the pistons 15, 15A are made different from each other as mentioned above, it is apparent that even when the compressor has a uniform pressure when activated, a net thrust load is applied to the rotary shaft 9**. This net thrust load is equivalent to the difference between the front thrust load and the rear thrust load.

Further, loads in the thrust direction are applied to the rotary shaft 9 by the urging force of the belleville spring 33 and the pressure in the pressure chamber 32 in this embodiment, as indicated by a straight line L in FIG. 5. The combined force of those loads is represented by $F_0$. The preload by the belleville spring 33 is constant. The load resulting from the pressure in the pressure chamber 32 slightly changes in accordance with the discharge pressure but is nearly constant.

The load $F_0$ represented by the line L acts against the front thrust load. The load $F_0$ in this embodiment is set slightly greater than the maximum value $F_{max1}$ of the front thrust load and less than the conventional maximum value $F_{max0}$ of the front thrust load. The setting of the load $F_0$ in this manner prevents rotary shaft 9 from fluttering and prevents abnormal sounds and abnormal vibration. This embodiment can also reduce the rotational resistance of the rotary shaft 9 as compared to the conventional compressor, thereby reducing the power loss.

In the case where the load in the thrust direction is given only by the urging force of the belleville spring 33, it becomes necessary to use a spring whose urging force is greater than the thrust load occurring when the discharge pressure becomes maximum. Since this embodiment is designed to generate an extra load from in the pressure chamber 32 using the discharge pressure, however, the urging force of the belleville spring 33 can be reduced so that the rotational resistance to the rotary shaft 9 and the power loss can be decreased further.

The strength of the urging force of the belleville spring 33 depends on the amount of the deformation of that spring. Since this deformation amount depends on the assembling precision of the cylinder blocks 1 and 2, the front housing 5 and the rear housing 6, there is a variation in the strength of the urging force of the belleville spring 33. When a reduction of the spring force by this variation is expected, it is necessary to previously set the urging force of the belleville spring 33 higher. On the contrary, since the above-described structure of the present embodiment permits the urging force of the belleville spring 33 to be set smaller, the variation becomes smaller so that the spring 33 can be produced with a high precision.

Further, the rotary valves 25 and 26 are used as inlet valves in this embodiment to bring about the following advantages.

When a flapper type inlet valve is used, the inlet valve firmly sticks around the suction port due to the lubricating oil sustained in the refrigerant gas, delaying the operation timing of the inlet valve. Since this type of inlet valve is positioned close to the suction port even when the suction port is opened, it acts as a resistance against the suction of the refrigerant gas. The delay of the operation timing and the suction resistance reduces the volumetric efficiency of the compressor.

In contrast, the use of the rotary valves 25 and 26 eliminates the problems with valve sticking and suction resistance caused by the lubricating oil. When pressures in the compression chambers Pa and Pb become slightly lower than the suction pressure in the swash plate chamber 11, the refrigerant gas spontaneously flows into the compression chambers Pa and Pb. The use of the rotary valves 25 and 26 can therefore improve the volumetric efficiency significantly as compared with the use of a flapper type inlet valve.

To make the areas of the front and rear heads 15*a* and 15*b* of each piston 15, 15A different from each other without changing the overall size of the compressor, one of the diameters of the front and rear cylinder bores 13, 13A and 14, 14A should be made smaller. This reduces the overall discharge displacement of the compressor. The improvement of the volumetric efficiency made by the use of the rotary valves 25 and 26, however, compensates for the reduction in discharge displacement.

Figure 6:
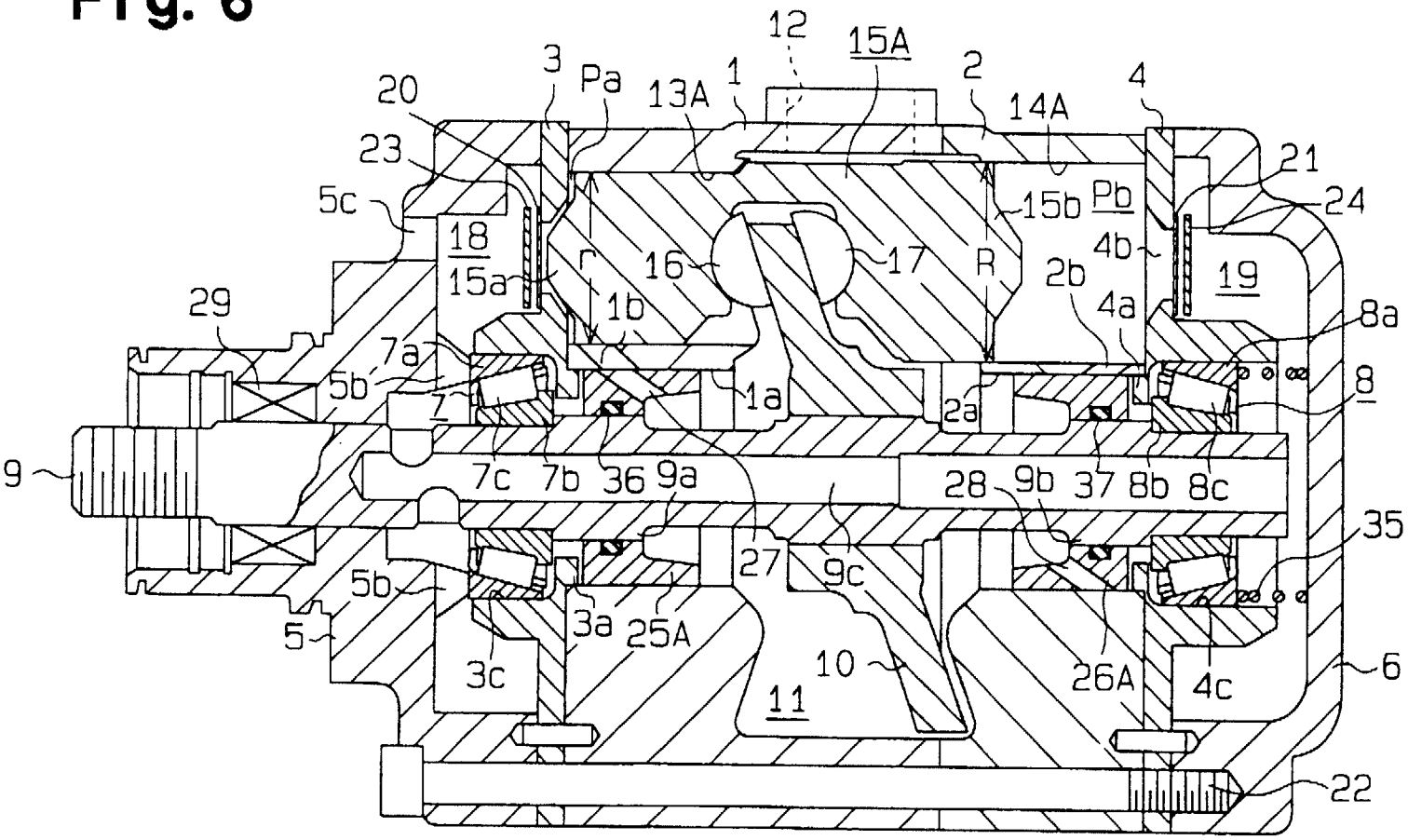
FIG. 6 is a side cross-sectional view showing a modification of the compressor.
Figure 7:
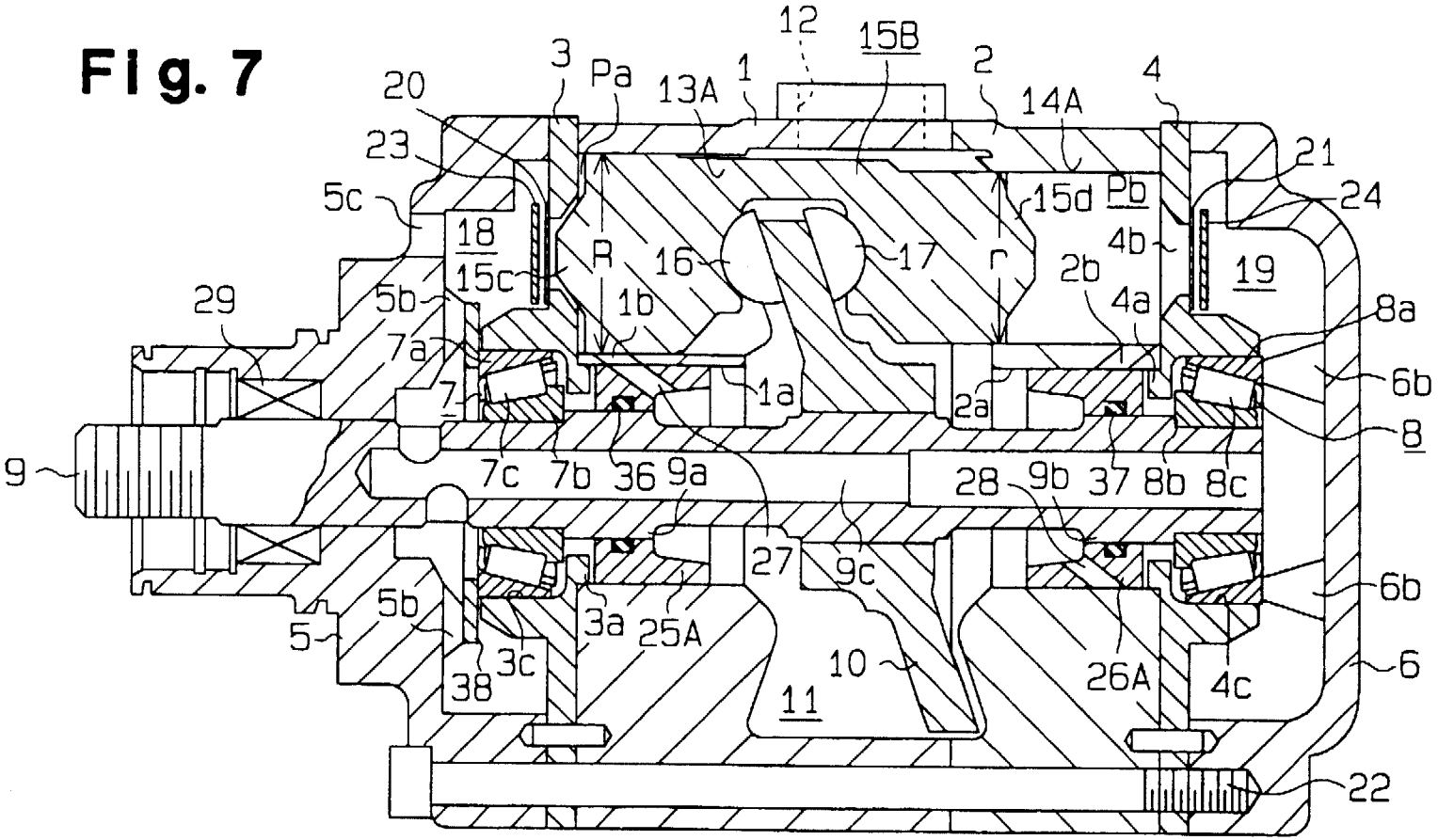
FIG. 7 is a side cross-sectional view showing another modification of the compressor.

Modifications as shown in FIGS. 6 and 7 will now be described, noting mainly the differences from the above-described embodiment. Like or same reference numerals as used for this embodiment will be used for the components of the modifications which have the same structures as those of this embodiment to avoid redundancy.

In the modification shown in FIG. 6, support holes 3*c* and 4*c* are formed in the valve plates 3 and 4. The rotary shaft 9 is rotatably supported in the support holes 3*c* and 4*c* via the roller bearings 7 and 8. A coil spring 35 intervenes between the outer race 8*a* of the roller bearing 8 and the rear housing 6. The coil spring 35 urges the roller bearing 8 forward, applying the preload to the rotary shaft 9.

A plurality of projections 5*b* are formed on the front housing 5. The projections 5*b* press the outer race 7*a* of the roller bearing 7 backward. The rear thrust load on the rotary shaft 9 is received by the front housing 5 via the roller bearing 7 and the projections 5*b*. The front thrust load on the rotary shaft 9 is received by the rear housing 6 via the roller bearing 8 and the coil spring 35.

The rear end of the rotary shaft 9 extends into the rear discharge chamber 19 so that it is urged forward by the discharge pressure. A discharge passage 9*c* is formed in the rotary shaft 9. The refrigerant gas in the rear discharge chamber 19 is therefore merged into the refrigerant gas in the front discharge chamber 18 via the discharge passage 9*c*, and the merged gas is discharged to the external refrigeration circuit from an outlet port 5*c* in the front housing 5. The provision of the discharge passage 9*c* in the rotary shaft 9 contributes to making the compressor more compact as compared with the case where discharge passages are provided in the cylinder blocks 1 and 2.

The direction of the pressure in the discharge chamber 19 acting on the rotary shaft 9 is the same as the urging direction of the coil spring 35. Those forces act as a load on the rotary shaft 9 to supplement the preload of the spring. Accordingly, the power loss is reduced as compared with the case where the preload is net supplemented.

The rotary valves 25A and 26A are firmly secured to the pair of large diameter portions 9*a* and 9*b* on the rotary shaft 9. Seal rings 36 and 37 intervene respectively between the rotary valve 25A and the rotary shaft 9 and between the rotary valve 26A and the rotary shaft 9. The rotary valves 25A and 26A are accommodated in the retaining holes 1*a* and 2*a*, respectively. The discharge pressures in the discharge chambers 18 and 19 act on the outer end portions of both rotary valves 25A and 26A, and the suction pressure in the swash plate chamber 11 acts on the inner end portions. Both rotary valves 25A and 26A shield the suction pressure area from the discharge pressure area. The suction, compression and discharge of the refrigerant gas are performed also in this modification as per the above-described embodiment.

In the modification shown in FIG. 7, a ring-shaped leaf spring 38 intervenes between the plurality of projections 5*b* on the front housing 5 and the outer race 7*a* of the roller bearing 7, and this spring 38 applies a preload to the rotary shaft 9. More specifically, the projections 5*b* abut on the outer surface of the leaf spring 38 and the outer surface of the spring 38 protrudes outward from the outer race 7*a*. The projections 5*b* push the outer surface portion of the leaf spring 38 against the roller bearing 7. Consequently, the leaf spring 38 deforms, applying a preload to the rotary shaft 9.

A plurality of projections 6*b* are formed on the rear housing 6. The projections 6*b* abut on the outer race 8*a* of the surface of the roller bearing 8. The rear thrust load on the rotary shaft 9 is received by the front housing 5 via the roller bearing 7, the leaf spring 38 and the projections 5*b*. The front thrust load on the rotary shaft 9 is received by the rear housing 6 via the roller bearing 8 and the projections 6*b*.

Further, in this invention, the maximum value $F_{max1}$ of the front thrust load can be set to a negative value by increasing the difference between the areas of the front and rear heads of each double-headed piston. This design can eliminate the need for the spring for applying a preload to the rotary shaft 9 or the structure for supplying the discharge pressure to the pressure chamber 32.

To receive the thrust load, an angular bearing or an ordinary ball bearing may be used in place of the roller bearing.

The cam plate in this invention maybe a wave cam, which is a cam whose surface is designed to permit each piston to reciprocate a plurality of times while the cam turns once.

A second embodiment of this invention will now be described in detail with reference to FIGS. 8 through 12, noting mainly the differences from the first embodiment.

Figure 8:
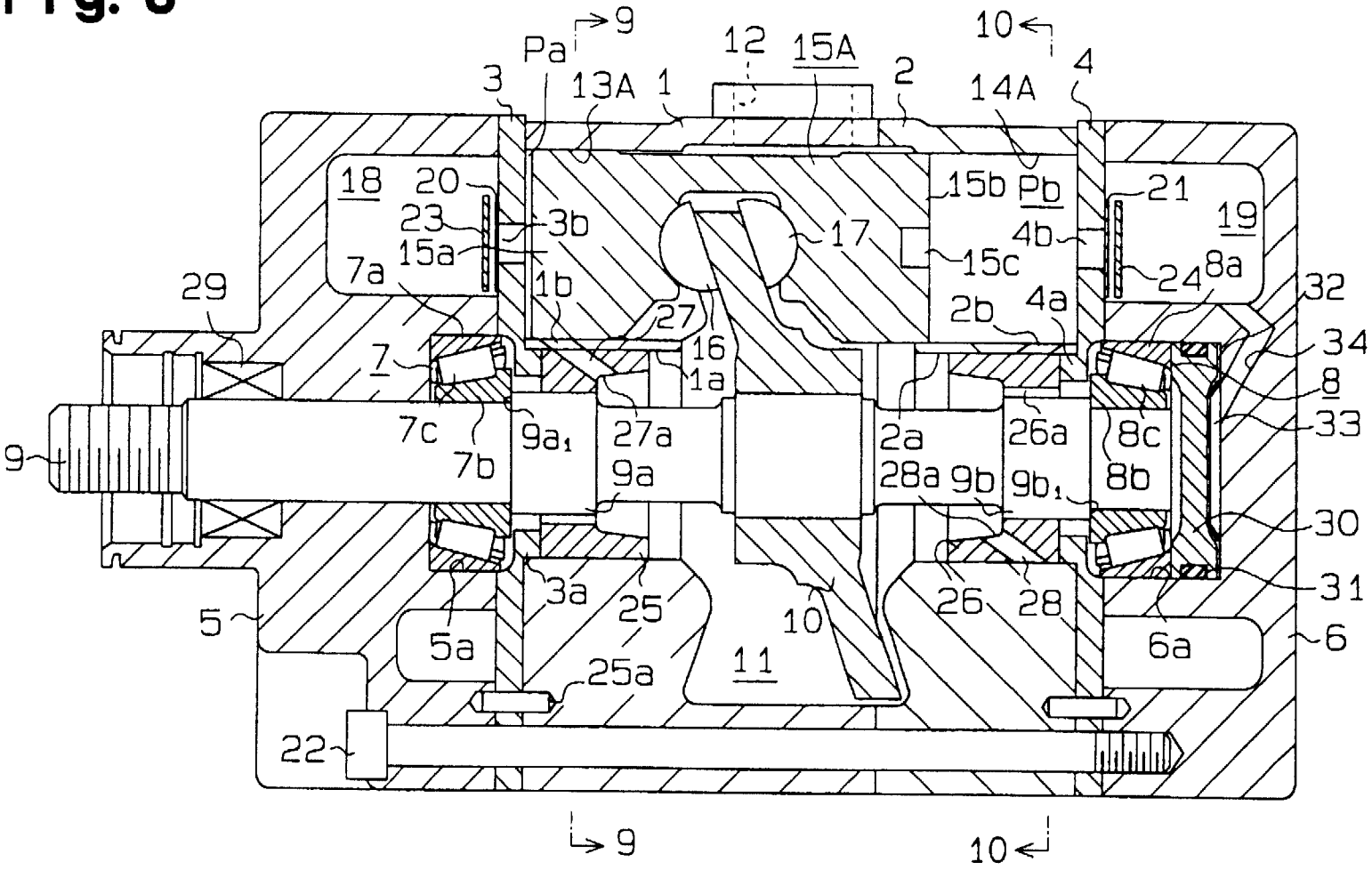
FIG. 8 is a side cross-sectional view illustrating the overall compressor according to a second embodiment of this invention.
Figure 9:
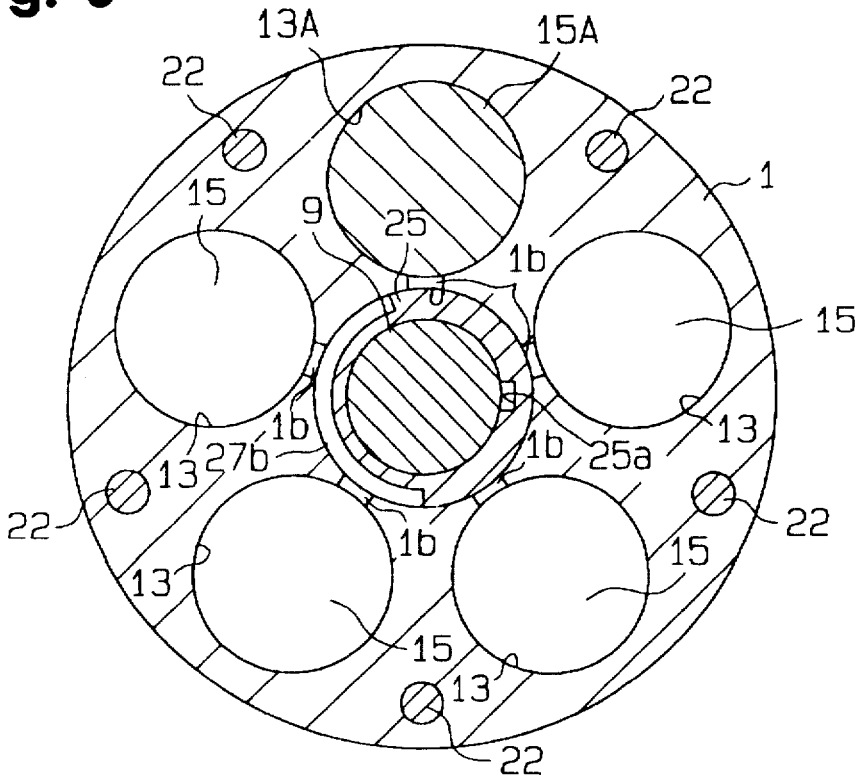
FIG. 9 is a cross-sectional view along the line 9—9 in FIG. 8.
Figure 10:
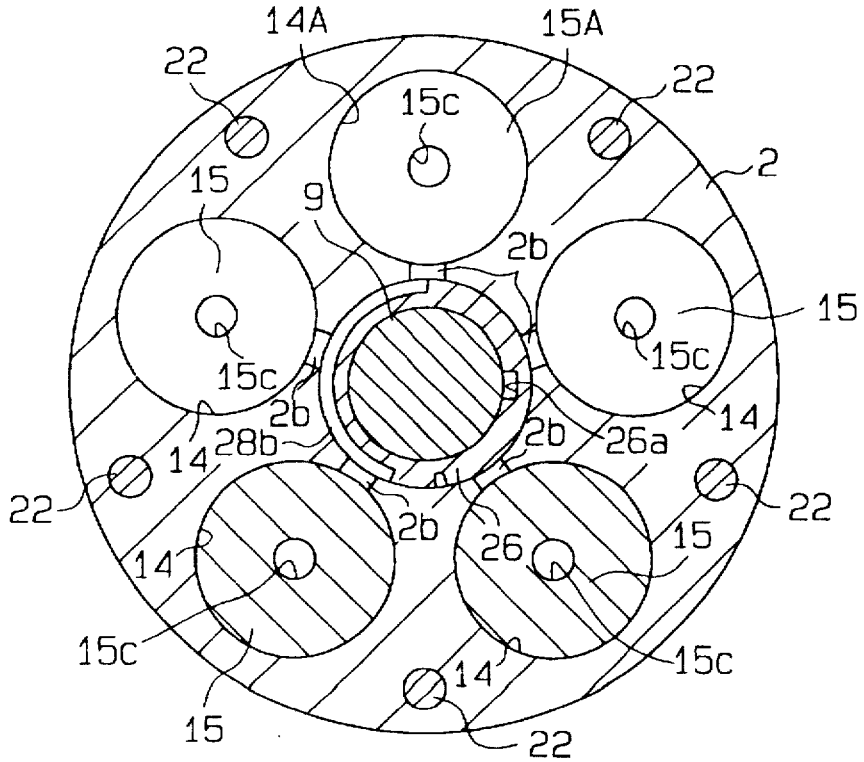
FIG. 10 is a cross-sectional view along the line 10—10 in FIG. 8.
Figure 11:
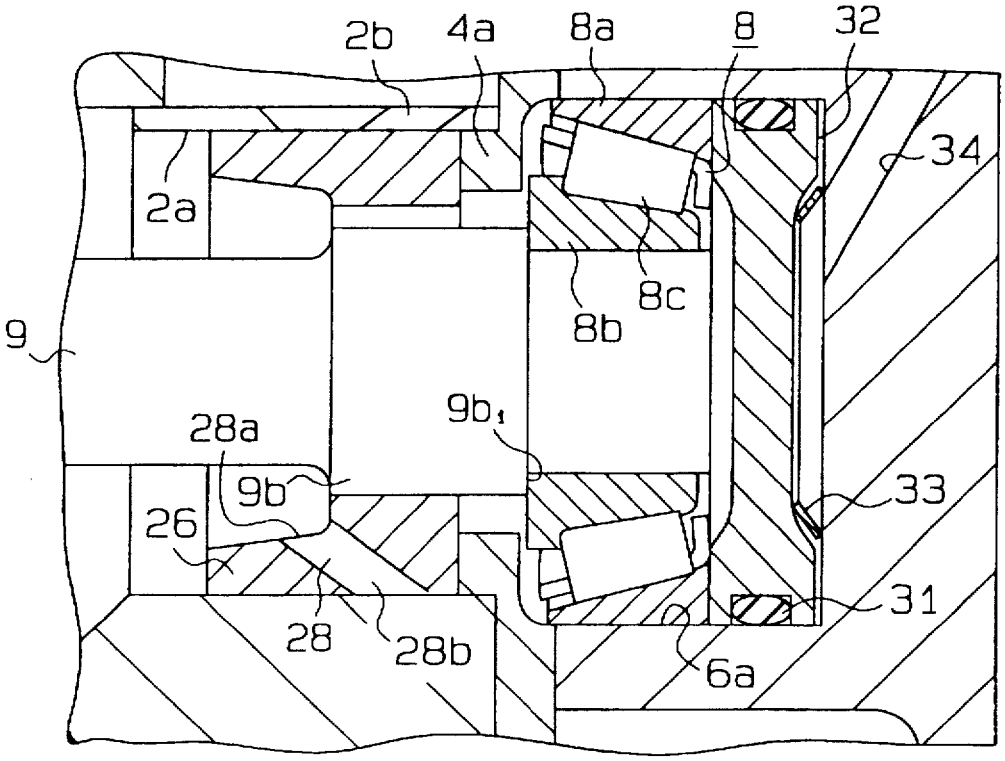
FIG. 11 is a side cross-sectional view showing a part of the compressor in FIG. 8 in enlargement.

As shown in FIGS. 8 and 10, a recess 15*c* is formed in the rear end face of each piston 15, 15A to expand the volume of the compression chamber Pb.

As shown in FIG. 8, when the front head 15*a* of the piston 15, 15A is at the top dead center with respect to the front cylinder bore 13, 13A, the volume "n" of the front compression chamber Pa is minimized and the volume of the rear compression chamber Pb is maximized. When the piston 15, 15A is at the top dead center with respect to the rear cylinder bore 14, 14A, the volume "N" of the rear compression chamber Pb is minimized and the volume of the front compression chamber Pa is maximized. When the volume of each compression chamber Pa or Pb is minimum, dead space is formed between the piston and valve plate and the refrigerant gas in that space is not discharged to the discharge chamber 18 or 19 from the discharge port 3*b* or 4*b* and remains there.

Figure 12A:
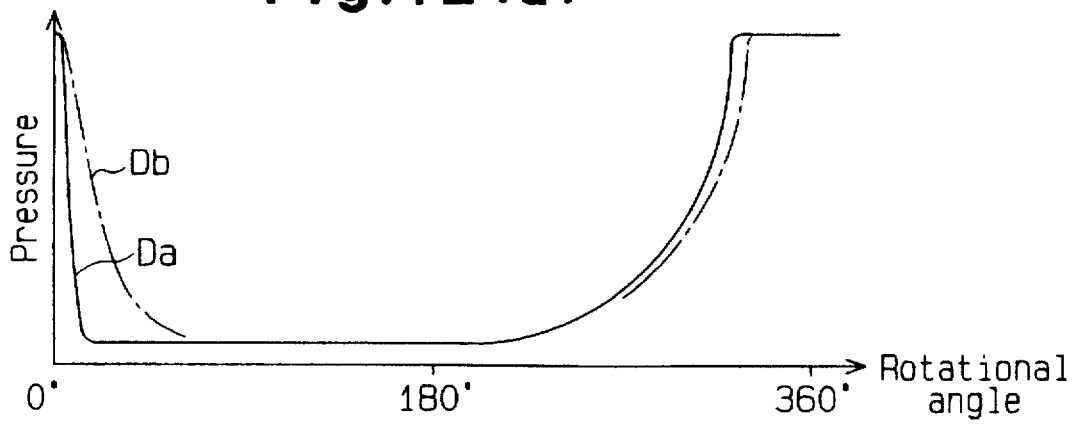
FIG. 12(*a*) is a graph representing a change in the pressure in a compression chamber.
Figure 12B:
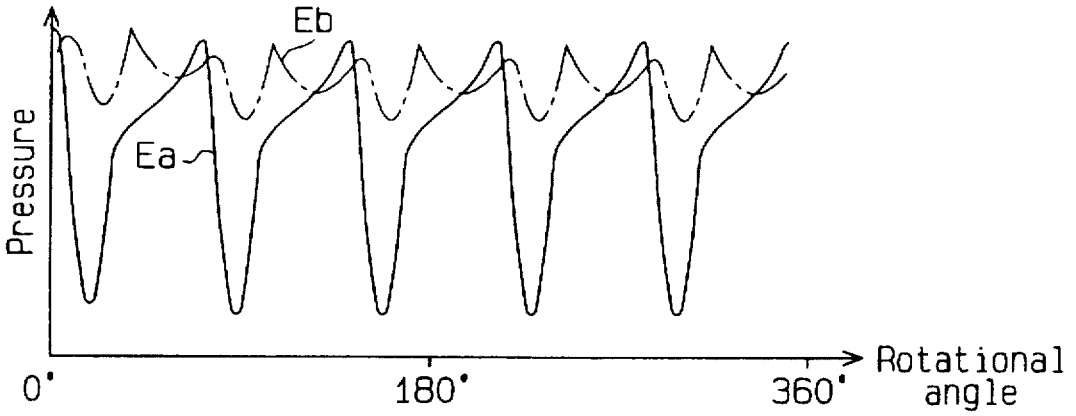
Figure 12C:
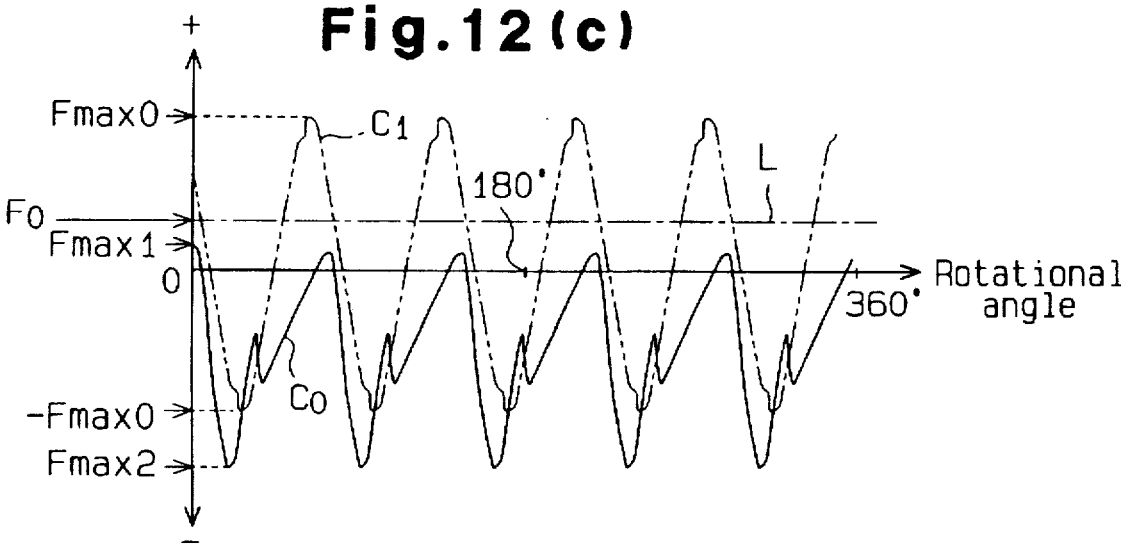

A curve Da in FIG. 12(*a*) represents a variation in pressure in the front compression chamber Pa, and a curve Db represents a variation in pressure in the rear compression chamber Pb. A curve Ea in FIG. 12(*b*) represents a variation only in the front thrust load pressure according to the pressure change in the compression chamber Pa or Pb. A curve Eb represents a variation only in the rear thrust load pressure according to the pressure change in the compression chamber Pa or Pb. It is apparent that every thrust load produced with respect to the rotary shaft 9 varies as indicated by a curve $C_0$ in FIG. 12(*c*).

The meanings of the terms and symbols in FIG. 12(*c*) are the same as shown in FIG. 5, and the curve $C_0$ is obtained by combining the curves Ea and Eb. The whole curve $C_0$ is shifted considerably toward the minus side on the vertical scale.

If the dead space in the compression chamber Pa equals the dead space in the compression chamber Pb as in the prior art, the thrust load changes nearly along the cosine curve as indicated by a curve $C_1$ in FIG. 12(*c*) or the curve $C_1$ FIG. 5. As the recess 15*c* is provided in the end face of the rear head 15*b* in this embodiment, however, the volume N of the dead space in the rear compression chamber Pb is greater than the volume n of the dead space in the front compression chamber Pa. In the suction stroke of the piston, the volume of the compression chamber increases and the refrigerant gas having remained in the dead space expands. The greater the dead space is, the lower the pressure in the compression chamber becomes in the suction stroke. It is therefore apparent from FIG. 12(*a*) that the pressure fall in the rear compression chamber Pb is smaller than the pressure fall in the front compression chamber Pa.

It is also apparent from the curve $C_0$ in FIG. 12(*c*) that the difference in size between the dead spaces in the front and rear compression chambers Pa and Pb reflects on the entire thrust load to the rotary shaft 9. For example, the maximum value $F_{max1}$ of the front thrust load is smaller than the maximum value $F_{max2}$ of the rear thrust load. This is because the dead space in the compression chamber Pb is set greater than the dead space in the compression chamber Pa.

A curve L in FIG. 12(*c*) represents the load $F_0$ applied to the rotary shaft 9 due to the deformation of the spring 33 and the pressure in the pressure chamber 32. The preload given to the rotary shaft 9 by the spring 33 is constant. The supplemental load by the pressure in the pressure chamber 32 slightly varies in accordance with the discharge pressure but is nearly constant. The rear thrust load is received by the front housing 5 via the front roller bearing 7, whereas the front thrust load is received by the rear housing 6 via the rear roller bearing 8, the partition 30 and the spring 33.

The load $F_0$ acts against the front thrust load. The load $F_0$ is therefore set slightly larger than the maximum value $F_{max1}$ of the front thrust load and lower than the conventional maximum value $F_{max0}$ of the front thrust load as in the first embodiment. Accordingly, the rotary shaft 9 does not flutter and the abnormal sounds and abnormal vibration can be prevented as in the first embodiment. This second embodiment can also reduce the rotational resistance to the rotary shaft 9 more than the prior art, thereby reducing the power loss.

Figure 13:
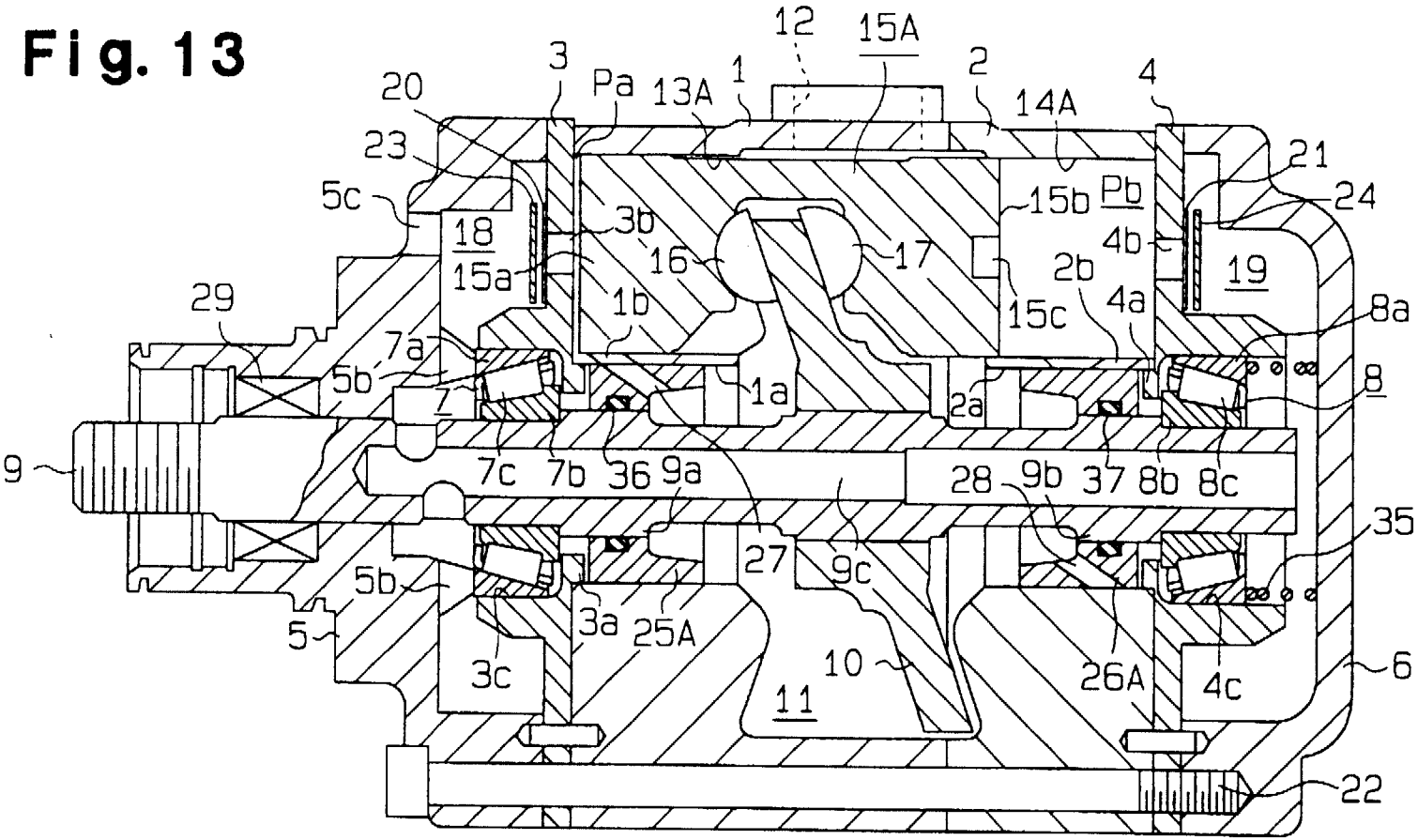
FIG. 13 is a side cross-sectional view showing the overall compressor according to a first modification of the second embodiment.

Modifications of the second embodiment will now be described with reference to FIGS. 13 through 18. The structure of the modification shown in FIG. 13 is the combination of the structure of the modification shown in FIG. 6 and that of the second embodiment shown in FIG. 8. More specifically, a recess 15*c* is formed in the rear end face of each piston 15 and a coil spring 35 is provided in the rear housing 6. This modification therefore brings about the function and advantages equivalent to those of the combination of the structures shown in FIGS. 6 and 8.

Figure 14:
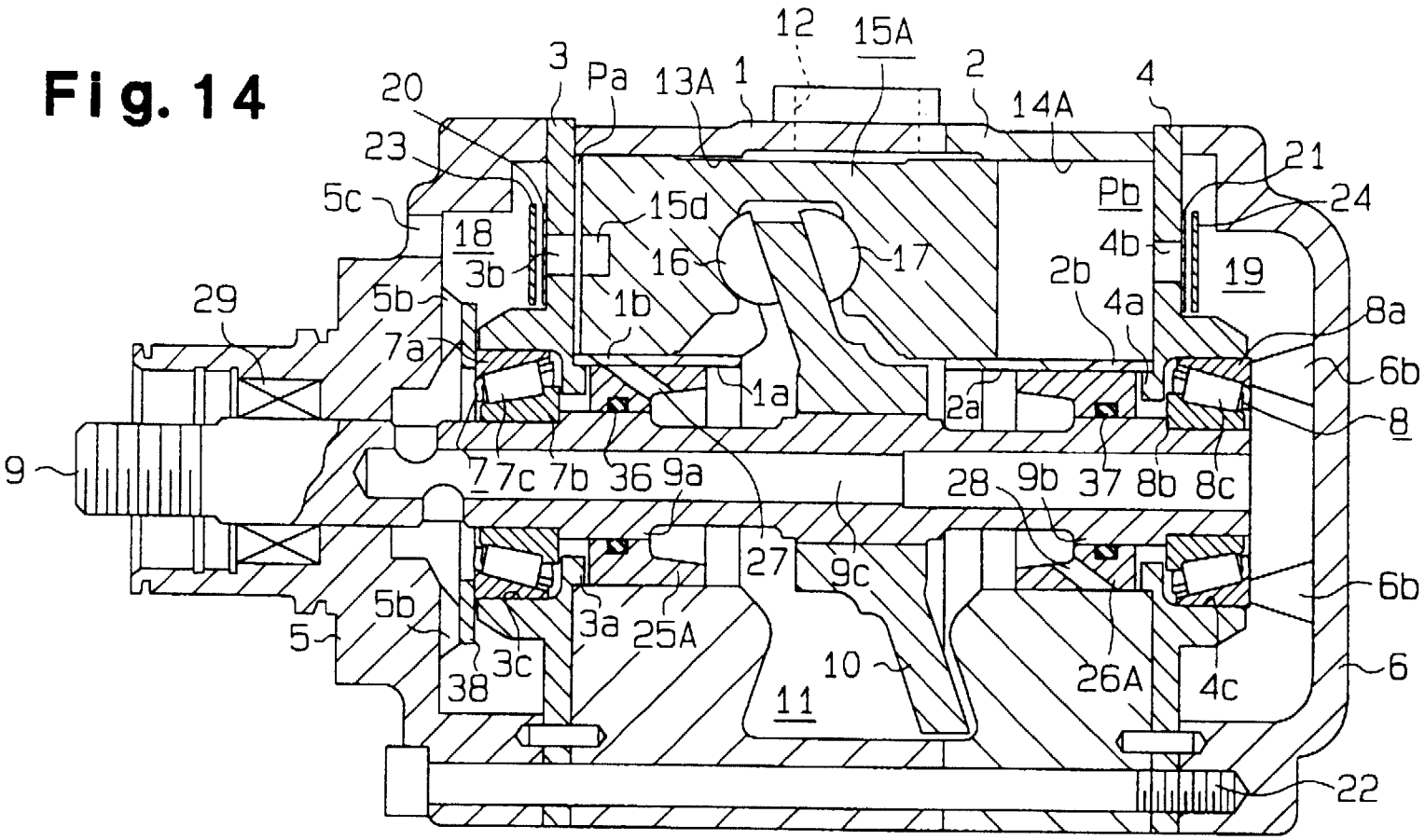
FIG. 14 is a side cross-sectional view showing the overall compressor according to a second modification.

The structure of the modification shown in FIG. 14 is the combination of the structure of the modification shown in FIG. 7 and that of the second embodiment shown in FIG. 8. More specifically, a recess 15*d* is formed in the front end face of each piston 15 and a leaf spring 38 is provided in the front housing 5. This modification therefore has the function and advantages equivalent to those of the combination of the structures shown in FIGS. 7 and 8.

Figure 15:
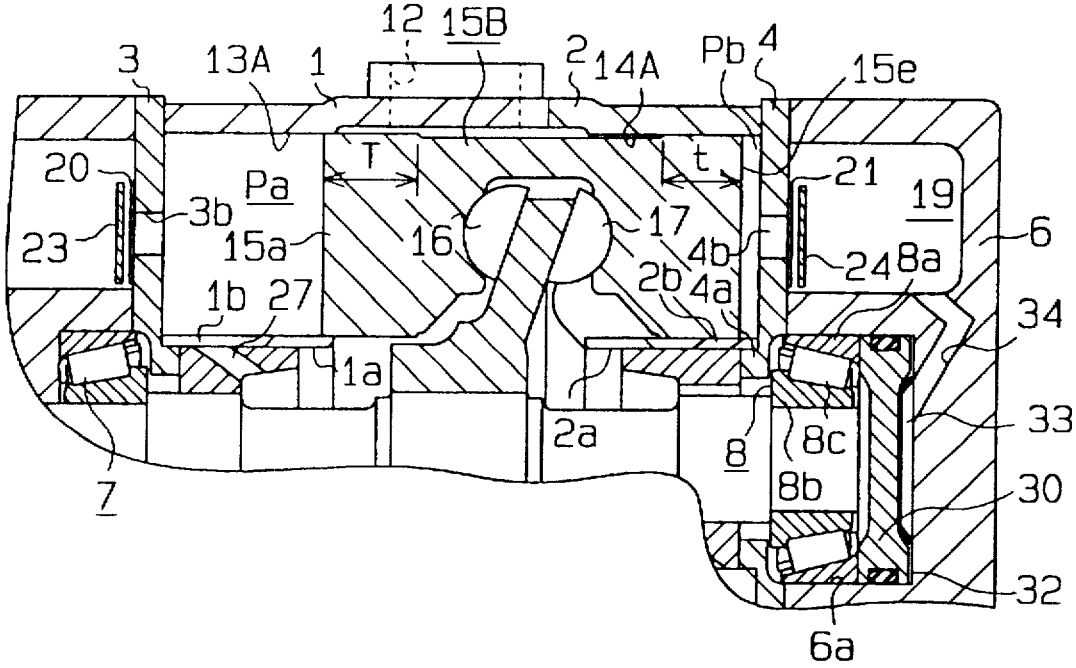
FIG. 15 is a side cross-sectional view of essential portions showing a third modification.

In the modification shown in FIG. 15, the structure for applying a load to the rotary shaft 9 is the same as the one in the second embodiment with the exception that the length "t" of the rear head 15*e* of a double-headed piston 15B is set shorter than the length "T" of the front head 15*a*. Accordingly, the volume of the dead space in the rear compression chamber Pb becomes larger than the volume of the dead space in the front compression chamber Pa. It is therefore possible to reduce the power loss while preventing vibration, as in the second embodiment.

Figure 16:
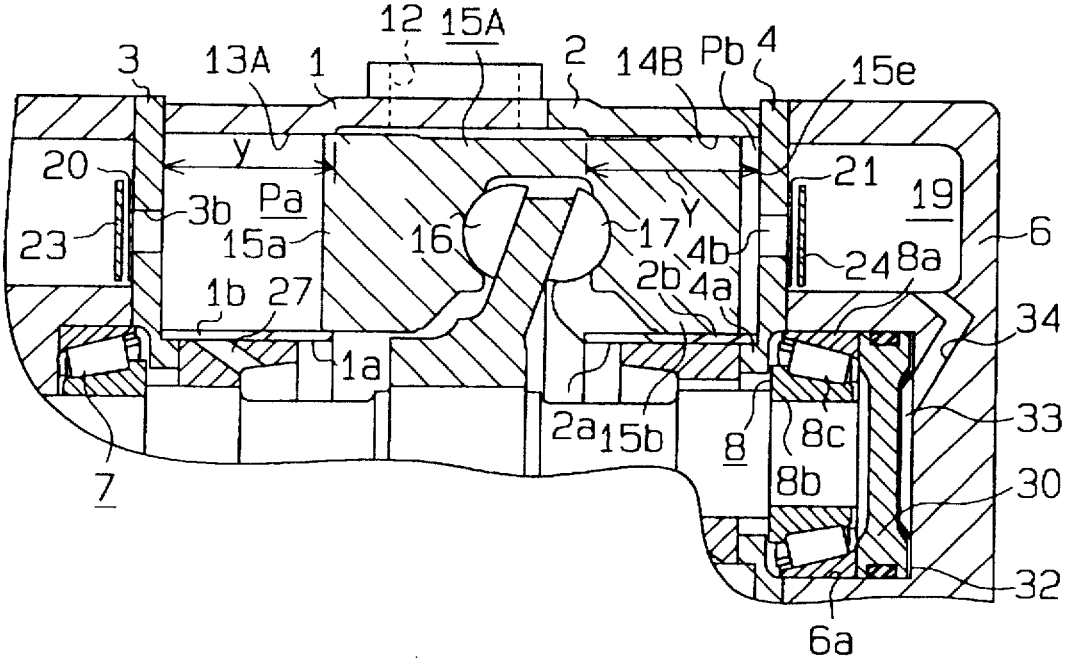
FIG. 16 is a side cross-sectional view of essential portions showing a fourth modification.

In the modification shown in FIG. 16, the structure for applying a load to the rotary shaft 9 is the same as the one in the second embodiment. The length "Y" of the rear cylinder bore 14B is set shorter than the length "y" of the front cylinder bore 13A. Accordingly, the volume of the dead space in the rear compression chamber Pb becomes larger than the volume of the dead space in the front compression chamber Pa. It is therefore possible to reduce the power loss while preventing vibration, as in the second embodiment.

Figure 17:
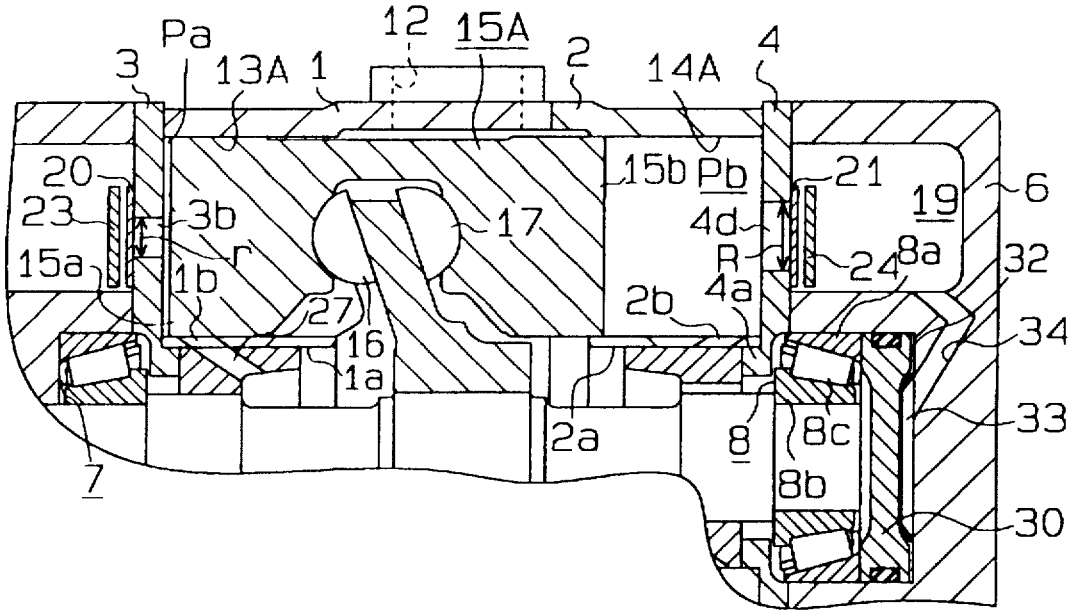
FIG. 17 is a side cross-sectional view of essential portions showing a fifth modification.

In the modification shown in FIG. 17, the structure for applying a load to the rotary shaft 9 is the same as the one in the second embodiment. However, the diameter "R" of the discharge port 4d with respect to the rear compression chamber Pb is set greater than the diameter "r" of the discharge port 3*b* with respect to the front compression chamber Pa and the cross-sectional area of the discharge port 4*d* is greater than that of the discharge port 3*b*. Accordingly, the volume of the dead space in the rear compression chamber Pb becomes larger than the volume of the dead space in the front compression chamber Pa, so that this modification can reduce the power loss while preventing the vibration as in the second embodiment.

Figure 18:
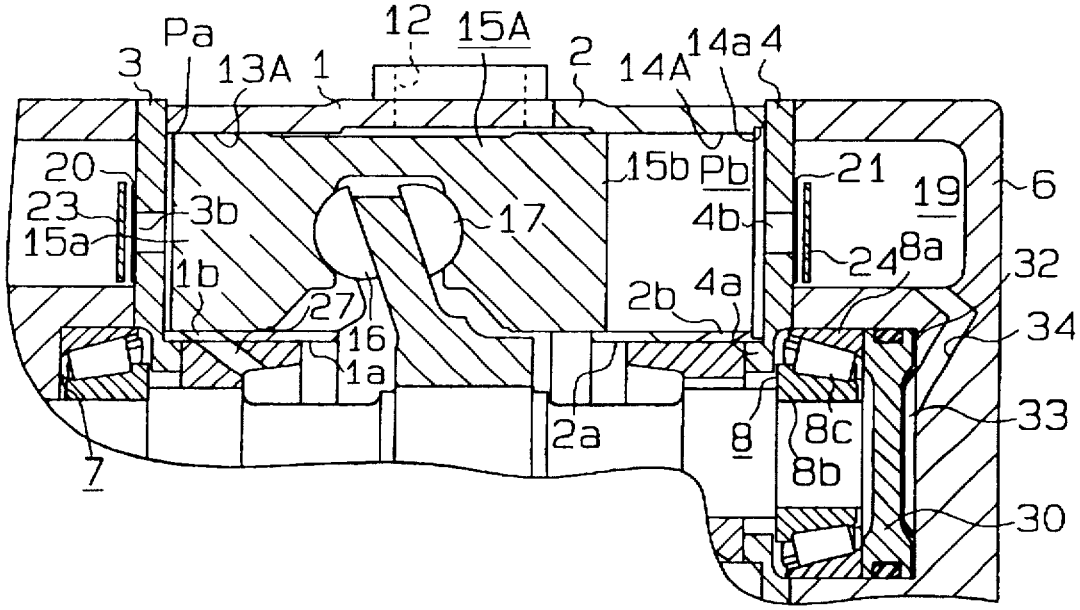
FIG. 18 is a side cross-sectional view of essential portions showing a sixth modification.

In the modification shown in FIG. 18, the structure for applying a load to the rotary shaft 9 is the same as the one in the first embodiment with the exception that an annular recess 14*a* is formed in the inner wall of the rear cylinder bore 14A. This recess 14*a* communicates with the dead space in the rear compression chamber Pb. Accordingly, the volume of the dead space in the rear compression chamber Pb becomes larger than the volume of the dead space in the front compression chamber Pa. It is therefore possible to reduce the power loss while preventing the vibration as in the first embodiment.

In the second embodiment and the modifications thereof, the maximum value $F_{max1}$ of the thrust load acting toward the compression chamber that has a larger dead space from the compression chamber that has a smaller dead space can be made to approach zero by increasing the difference between the dead spaces in the front and rear compression chambers (see FIG. 12(*c*)). The desired load can therefore be obtained even if the compressor is modified to apply the load to the rotary shaft only by permitting the discharge pressure to act on the rotary shaft. In this case, the springs 33, 35 and 38 become unnecessary.

Although the embodiments utilize the swash plate as a cam plate, a wave plate disclosed in U.S. Pat. No. 4,756,239 or the like may be used.

What is claimed is:

1. A compressor having a front direction and a rear direction, comprising:

a cylinder block;

a rotary shaft;

a cam plate attached in fixed position on said rotary shaft;

a plurality of cylinder bores defined in said cylinder block around the rotary shaft;

a corresponding plurality of double-headed pistons respectively accommodated in said cylinder bores, each double headed piston having a front head and an opposite rear head;

a plurality of front and rear compression chambers respectively defined by said bores at the front and rear of the respective of said pistons, whereby said pistons compress refrigerant gas in said front and rear compression chambers responsive to the rotation of said cam plate;

a plurality of suction ports respectively connected to each of the bores;

a plurality of suction valves respectively associated with each of the suction ports;

a plurality of discharge ports respectively connected to each of the bores;

a plurality of discharge valves respectively associated with each of the discharge ports; and respective front and rear bearing means for rotatably supporting the rotary shaft and for receiving thrust loads applied to the rotary shaft during operation of the compressor, wherein the pistons generate a net thrust load determined by the difference between the maximum of the sum of the loads applied to the front heads of the pistons by the refrigerant gas in the front compression chambers and the maximum of the sum of the loads applied to the rear heads of the pistons by the refrigerant gas in the rear compression chambers;

said net thrust load being applied in only one axial direction of said rotary shaft during operation of the compressor whereby said pistons and said cam plate transfer said net thrust load to only one of said front and rear bearing means during operation of the compressor.

2. A compressor according to claim 1 further comprising means for applying a preload of a predetermined magnitude to the bearing means.

3. A compressor according to claim 2 further comprising:

a discharge chamber accommodating the compressed refrigerant gas; and means for supplementing the preload based on the pressure in the discharge chamber.

4. A compressor according to claim 1, wherein each piston has a front pressure receiving area and a rear pressure receiving area, and wherein the front pressure receiving area and the rear pressure receiving area of each piston are different from each other.

5. A compressor according to claim 1, wherein a dead space is formed in each compression chamber when each piston is positioned at top dead center in its stroke; and said dead spaces respectively in said front and rear compression chambers have respective volumes which are different from each other.

6. A compressor according to claim 5, wherein said dead spaces are defined by a front surface and a rear surface of each piston and wherein said front surface has a different surface area than said rear surface.

7. A compressor according to claim 5, wherein a recess is formed only on one of the rear side and the front side of each piston.

8. A compressor according to claim 5, wherein the front and rear compression chambers differ from one another in length.

9. A compressor according to claim 5, wherein an inner wall of one of the rear compression chamber and the front compression chamber is partially cut away.

10. A compressor according to claim 2, wherein said means for applying a preload includes a spring.

11. A compressor according to claim 10, wherein said spring is a belleville spring.

12. A compressor according to claim 10, wherein said spring is a coil spring.

13. A compressor according to claim 10, wherein said spring is a leaf spring.

14. A compressor according to claim 3, wherein said means for supplementing the preload includes:

a pressure chamber defined adjacent to an extension of the rotary shaft and communicating with the discharge chamber; and a transfer member for transferring pressure in the pressure chamber to the rotary shaft.

15. A compressor according to claim 1, which further comprises:

a spring for applying a preload to said rotary shaft in said single axial direction of said rotary shaft during operation of the compressor; and means for supplementing said spring preload by transferring a portion of the discharge pressure of said refrigerant gas from said compression chambers to said rotary shaft in said single direction of said rotary shaft.

16. A compressor according to claim 15, wherein each piston has a front pressure receiving area and a rear pressure receiving area, and wherein the front pressure receiving area and the rear pressure receiving area on each piston are different from each other.

17. A compressor according to claim 15, wherein a dead space is formed in each compression chamber when each piston is positioned at top dead center in its stroke; and said dead spaces respectively in said front and rear compression chambers have respective volumes which are different from the other.

18. A compressor according to claim 15 further comprising a front bearing and a rear bearing rotatably supporting a front end and a rear end of the rotary shaft, respectively.

19. A compressor according to claim 18, wherein each bearing has a pair of races and a plurality of rollers arranged between the races.

20. A compressor according to claim 19, wherein each roller is arranged along a substantially conical surface, and each roller has an outer end located near the rotary shaft and an inner end spaced apart from the rotary shaft.

21. A compressor having a front direction and a rear direction, comprising:

a cylinder block;

a rotary shaft;

a cam plate attached in fixed position on said rotary shaft;

a cam plate chamber defined in said cylinder block to contain refrigerant gas and to accommodate the cam plate;

a plurality of cylinder bores defined in said cylinder block around the rotary shaft;

a corresponding plurality of double-headed pistons respectively accommodated in said cylinder bores, each double-headed piston having a front head and an opposite rear head;

a plurality of front and rear compression chambers respectively defined by said bores at the front and rear of the respective of said pistons, whereby the pistons compress refrigerant gas in said front and rear compression chambers responsive to the rotation of said cam plate;

a plurality of suction ports respectively connected to each of the bores;

a pair of rotary valves attached to the rotary shaft for integral rotation therewith, one rotary valve being located on each side of the cam plate, each rotary valve serving to supply the refrigerant gas contained in the cam plate chamber to each front and rear compression chamber through the respective suction ports in accordance with the rotation of the rotary valves;

a plurality of discharge ports respectively connected to each of the bores;

a plurality of discharge valves respectively associated with each of the discharge ports; and respective front and rear bearing means for rotatably supporting the rotary shaft and for receiving thrust loads applied to the rotary shaft during operation of the compressor, wherein the pistons generate a net thrust load determined by the difference between the maximum of the sum of the loads applied to the front heads of the pistons by the refrigerant gas in the front compression chambers and the maximum of the sum of the loads applied to the rear heads of the pistons by the refrigerant gas in the rear compression chambers;

said net thrust load being applied in only one axial direction of the rotary shaft during operation of the compressor whereby the pistons and the cam plate transfer the net thrust load to only one of said front and rear bearing means during operation of the compressor.

22. A compressor according to claim 15 further comprising:

front and rear discharge chambers respectively accommodating the compressed refrigerant gas;

a front plate partitioning the front discharge chamber and each front compression chamber, said front plate having the front discharge ports formed therein for communicating the front discharge chamber with each front compression chamber;

a rear plate partitioning the rear discharge chamber and each rear compression chamber, said rear plate having the rear discharge ports formed therein for communicating the rear discharge chamber with each rear compression chamber;

a dead space defined in each compression chamber between the associated piston and the associated plate when the associated piston is positioned at top dead center in its stroke; and each said front discharge port and each said rear discharge port being different in diameter from each other to provide a difference in the respective volumes of the dead spaces between each front compression chamber and each rear compression chamber.

23. A compressor according to claim 21, which further comprises:

a spring for applying a preload to the rotary shaft in said single axial direction of the rotary shaft during operation of the compressor.

24. A compressor according to claim 23, which further comprises:

means for supplementing said spring preload by transferring a portion of the discharge pressure of the refrigerant gas from the compression chambers to the rotary shaft in said single direction of the rotary shaft.

* * * * *

UNITED STATES PATENT AND TRADEMARK OFFICE

CERTIFICATE OF CORRECTION

PATENT NO. : 5,765,996

DATED : June 16, 1998

INVENTOR(S) : FUJII et al.

It is certified that error appears in the above-indentified patent and that said Letters Patent is hereby corrected as shown below:

Column 1, line 44, delete " of" .

Column 2, line 12, change first word " bearing" to --bearings--.

Column 3, line 35, change " portion" to --portions-- (second occurrence); and after " 9c" , insert --and 9d--.

Column 4, lines 15 and 16, change " opening the of" to --opening of the--;

line 52, change " 16" to --1b--.

Column 5, line 44, change " supplement" to --supplements--.

UNITED STATES PATENT AND TRADEMARK OFFICE

CERTIFICATE OF CORRECTION

PATENT NO. : 5,765,996

DATED : June 16, 1998

INVENTOR(S) :

FUJII et al.

It is certified that error appears in the above-indentified patent and that said Letters Patent is hereby corrected as shown below:

Column 6, line 42, after " Further" , delete --,-- (comma);

line 66, after " from" ; delete " in" .

Column 8, line 18, change " net" to --not--.

Signed and Sealed this

Fifth Day of October, 1999

*Attest:*

*Attesting Officer*

Q. TODD DICKINSON

*Acting Commissioner of Patents and Trademarks*